US005630344A

United States Patent [19]

Nammoto

[11] Patent Number: 5,630,344

[45] Date of Patent: May 20, 1997

[54] SIDE-ENTRY, RATCHETED WRENCH ASSEMBLY

[76] Inventor: Yuji Nammoto, 5751 SW. 39th St., Davie, Fla. 33314

[21] Appl. No.: 591,824

[22] Filed: Jan. 25, 1996

[51] Int. Cl.[6] ..... B25B 13/28

[52] U.S. Cl. ..... 81/91.2; 81/111

[58] Field of Search ..... 81/90.1, 91.2, 81/111

[56] References Cited

U.S. PATENT DOCUMENTS

| | | | |
|---|---|---|---|
| 742,389 | 10/1903 | Bullard | 81/91.2 X |
| 996,841 | 7/1911 | Dixon . | |
| 1,337,509 | 4/1920 | Fletcher . | |
| 2,476,369 | 7/1949 | Gutowski . | |
| 2,618,996 | 11/1952 | Logan | 81/91.2 X |
| 3,044,335 | 7/1962 | Keranen . | |
| 4,534,245 | 8/1985 | Rossmann . | |
| 4,718,315 | 1/1988 | Nitschmann . | |
| 4,913,011 | 4/1990 | Ma . | |
| 5,050,464 | 9/1991 | Hurtig . | |
| 5,282,830 | 2/1994 | Reynolds . | |

FOREIGN PATENT DOCUMENTS

| | | | |
|---|---|---|---|
| 577930 | 8/1924 | France | 81/91.2 |

*Primary Examiner*—James G. Smith
*Attorney, Agent, or Firm*—Malloy & Malloy, P.A.

[57] ABSTRACT

A side-entry, ratcheted wrench assembly having a handle segment, and first and second jaw members, each including a collar segment, a hub segment, and a pivot segment extending from the hub segment. Both the collar segments include exterior and interior ends, and an interior contact face extending therebetween, and define a bolt retention area wherein a bolt is retained. Further, the first pivot segment is pivotally secured to the handle segment, and the second pivot segment is pivotally secured to the first hub segment so as to provide for pivotal movement of the jaw members relative to one another between an engaged and a disengaged orientation. The engaged orientation includes the interior ends of the collar segments abutting one another so as to retain the bolt in the retention area, without clamping down on it, and is achieved and locked upon pivotal movement of the first jaw member in a first direction relative to the handle segment. Conversely, the disengaged orientation includes the jaw members pivoting relative to one another so that the exterior ends of the collar segments are spaced a maximum distance from one another and side entry of the bolt into the retention area is permitted. The disengaged orientation is achieved upon the first jaw member pivoting in a second direction which allows ratcheted rotation of the collar segments about the bolt without effecting rotation thereof.

14 Claims, 2 Drawing Sheets

SIDE-ENTRY, RATCHETED WRENCH ASSEMBLY

BACKGROUND OF THE INVENTION

1. Field of the Invention

The present invention is directed towards a side-entry, ratcheted wrench assembly which can be used to conveniently and effectively loosen or tighten a bolt or like article, which is disposed in a difficult to access or reach location, without requiring a great degree of maneuvering space or any clearance above the bolt, and while exerting substantially all of a force for tightening or loosening the bolt as a torque force and not a clamping force which could damage the bolt, and in particular a plastic or non metal bolt.

2. Description of the Related Art

The field of art relating to ratcheted wrench assemblies, and in particular, side-entry ratcheted wrench assemblies is substantially crowded, with seemingly small variations providing numerous different, patentably distinct inventions. A primary reason for the numerous patentably distinct inventions in this crowed art relates to the specialized needs of various industries and various types of equipment with regard to the use of a ratcheted wrench assembly to tighten or loosen a bolt or like article.

An important and specialized problem which remains unaddressed by known assemblies relates to the requirements during tightening and loosening of nonmetal bolts, such as plastic bolts on toys and the like, and the substantial bolt clamping force exhibited by known designs. In particular, conventional designs tend to substantially clamp down on the bolt to effectuate gripping and hence turning thereof. Such clamping, however, can easily lead to deterioration of the exterior surface of the bolt and/or breakage of the bolt itself. Of course, such deterioration ("stripping") and/or breakage of the bolt requires bolt replacement and can make removal of the bolt substantially more difficult. As such, there is a substantial need in the art for a ratcheted wrench assembly which is capable of being implemented in tight locations, with a small maneuvering area and a limited range of movement, but which is configured in such a manner that the force for loosening or tightening the bolt results from a torque force exerted by the wrench and not a clamping type force which can potentially damage the bolt. Specifically, a torque force maintains effective engagement only during rotation, and is less susceptible to accidental slippage or bolt deterioration during use.

In addition to the specialized need associated with the loosening or tightening of non-metal bolts, the need to manufacture a ratcheted wrench assembly in a cost effective and simplified, yet highly effective assembly remains a significant need in the art. For example, known ratcheted wrench assemblies generally include a variety of small independent and interlocked components to make up the complex inner-workings thereof and achieve the ratcheting function. Naturally, however, the incorporation of numerous small, independent components makes such assemblies quite expensive, due both to the added machining costs associated with making numerous, small, intricate parts and to the substantial added labor costs that result from the skill requirements and added assembly time involved in producing a finished product. Additionally, the use of numerous small, intricate parts makes those assemblies much more susceptible to excess wear or breakdown as the internal components more easily become corroded, dirty or otherwise inoperable. As such, there is still a substantial need in the art for a side-entry, ratcheted wrench assembly which incorporates a simple yet effective design, is easy to clean and maintain effective and operational, and can be relatively inexpensively manufactured.

SUMMARY OF THE INVENTION

The present invention is directed towards a side-entry, ratcheted wrench assembly. In particular, the ratcheted wrench assembly includes a generally elongate handle segment having a first end and a second end. Further, structured to extend from the first end of the handle segment is a first jaw member. The first jaw member includes a first collar segment, a first hub segment, and a first pivot segment. The first pivot segment, which extends from the first hub segment, is specifically structured to be pivotally secured to the handle segment at generally its first end. Accordingly, the first pivot segment functions to secure the first jaw member to the handle segment and provide for pivotal movement between the first jaw member and the handle segment. As to the first collar segment, it includes an exterior end, an interior end, and a first interior contact face which extends from the exterior end to the interior end.

The ratcheted wrench assembly of the present invention also includes a second jaw member. The second jaw member, which includes a second collar segment, a second hub segment and a second pivot segment, is structured to be pivotally secured to the first jaw member. In particular, the second pivot segment extends from the second hub segment and is structured to be pivotally secured to the first hub segment of the first jaw member. Accordingly, the pivotal movement of the second jaw member relative to the first jaw member can be effectively achieved, and pivotal movement of both jaw members relative to the handle segment is also achieved. Much like the first collar segment, the second collar segment of the second jaw member includes an exterior end, an interior end, and a second interior contact face extending from its exterior end to its interior end.

As a result of the pivotal interconnection, the first and second jaw members are structured to move relative to one another between a generally engaged and a generally disengaged orientation. In the engaged orientation, the interior end of the first collar segment is structured to abut the interior end of the second collar segment such that the first interior contact face and the second interior contact face define a retention area wherein a head of a bolt to be turned is retained without being clamped down upon. Conversely, the disengaged orientation includes the second jaw member pivoting about an end of the second pivot segment that is secured to the first hub segment such that the exterior end of the second collar segment and the exterior end of the first collar segment are spaced a maximum distance from one another and side-entry of a bolt into the retention area therebetween is permitted.

Additionally, so as to engage the second jaw member and maintain it within its engaged orientation, lock means are included. The lock means are structured to retain the second jaw member in the engaged orientation when the first jaw member, to which the second jaw is pivotally secured, pivots in a first direction relative to the handle segment. Furthermore, upon that pivotal movement in the first direction and engagement of the lock means with the second jaw member, the bolt, which is securely retained in the retention area, is turned as a result of a torque force rather than a clamping force. Moreover, upon the first jaw member pivoting in a second direction relative to the handle segment, the second jaw member is structured to pivot generally into the disengaged orientation and thereby permit free ratcheted rotation of the first and second collar segments about the bolt without causing rotation thereof.

It is an object of the present invention to provide a side-entry, ratcheted wrench assembly which requires a small access area to effectively engage and turn a bolt.

Another object of the present invention is to provide a side-entry, ratcheted wrench assembly which can be effectively utilized with plastic and nonmetal bolts without damaging the bolts during tightening and loosening thereof.

A further object of the present invention is to provide a side-entry, ratcheted wrench assembly which securely retains a bolt therein during tightening and loosening as a result of a torque force rather than a clamping force, thereby minimizing the risk of striping or damaging the head of the bolt during tightening or loosening.

Yet another object of the present invention is to provide a side-entry, ratcheted wrench assembly which includes substantially few numbers of components, yet is durable and effective.

Still another object of the present invention is to provide a side-entry, ratcheted wrench assembly which is cost effective and easy to manufacture and incorporates a long-lasting malfunction free design.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
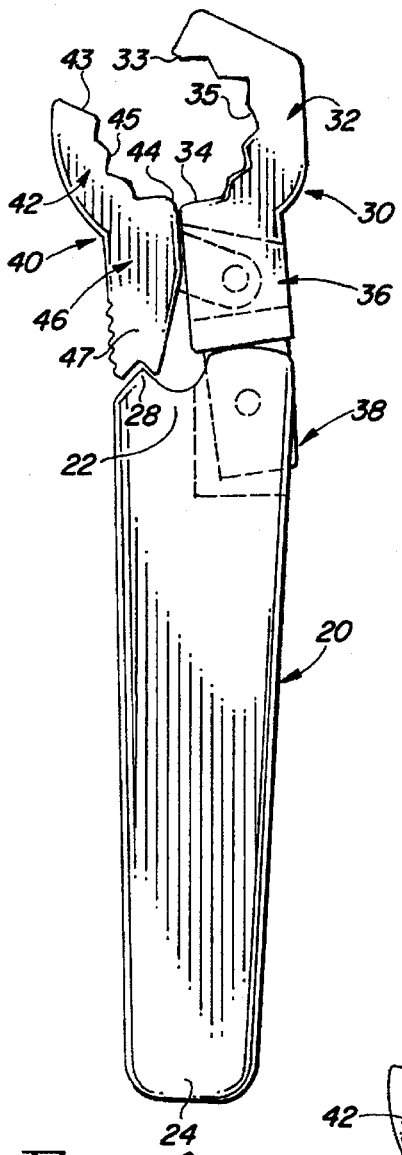
FIG. 1 is a side view of the present invention in its engaged orientation.

Shown throughout the Figures, the present invention is directed towards a side-entry, ratcheted wrench assembly, generally indicated as 10. The ratcheted wrench assembly 10, which is preferably constructed of a strong, durable, rigid material, is structured to facilitate the tightening and loosening of bolts, and in particular, more fragile plastic or nonmetal bolts disposed in difficult to access locations.

Looking specifically to the ratchet assembly 10, it includes a handle segment 20. Preferably, the handle segment 20 is somewhat elongate and as such facilitates convenient grasping by a user and provides for somewhat far reaching access by the wrench assembly 10. Furthermore, the handle segment 20 includes a first end 22 and second end 24, with the second end 24 defining the but of the handle 20 which is grasped by the user.

Extending from the first end 22 of the handle segment 20 is a first jaw member 30. The first jaw member 30 includes primarily a first collar segment 32, a first hub segment 36, and a first pivot segment 38. Further, the first jaw member 30 is pivotally secured to the handle segment 20, at its first end 22, by the first pivot segment 38. While a variety of pivotal interconnections are acceptable, in the preferred embodiment the handle segment 20 includes a channel 26 defined therein and extending through the first end 22 thereof. The channel 26 is structured to receive the first pivot segment 38 for pivotal captivation therein. In particular, the first pivot segment 38 preferably includes a pivot aperture 39 through which a pivot pin or like element extends in order to pivotally secure the first pivot segment 38 within the channel 26 of the handle segment 20. Moreover, it is preferred that an interior of the channel 26 be structured to abut the first pivot segment 38 and resist pivotally movement of the first jaw member 30 in a second direction, as will be described in greater detail subsequently.

Looking further to the first jaw member 30, the first collar segment 32 thereof includes an exterior end 33, an interior end 34, and a first interior contact face 35. The first interior contact face 35 preferably includes a notched or hex type surface configuration and is structured to extend from the exterior end 33 to the interior end 34 of the first collar segment 32. Preferably, the first hub segment 36 extends down from the interior end 34 of the first collar segment 32, and the first pivot segment 38 in turn extends down from the first hub segment 36 into its secure, pivotal engagement with the handle segment 20.

Figure 3:
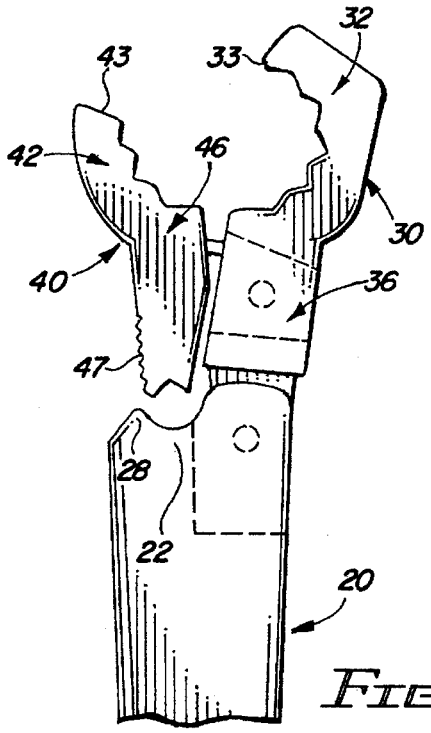
FIG. 3 is a side view of the present invention in its disengaged orientation.
Figure 4:
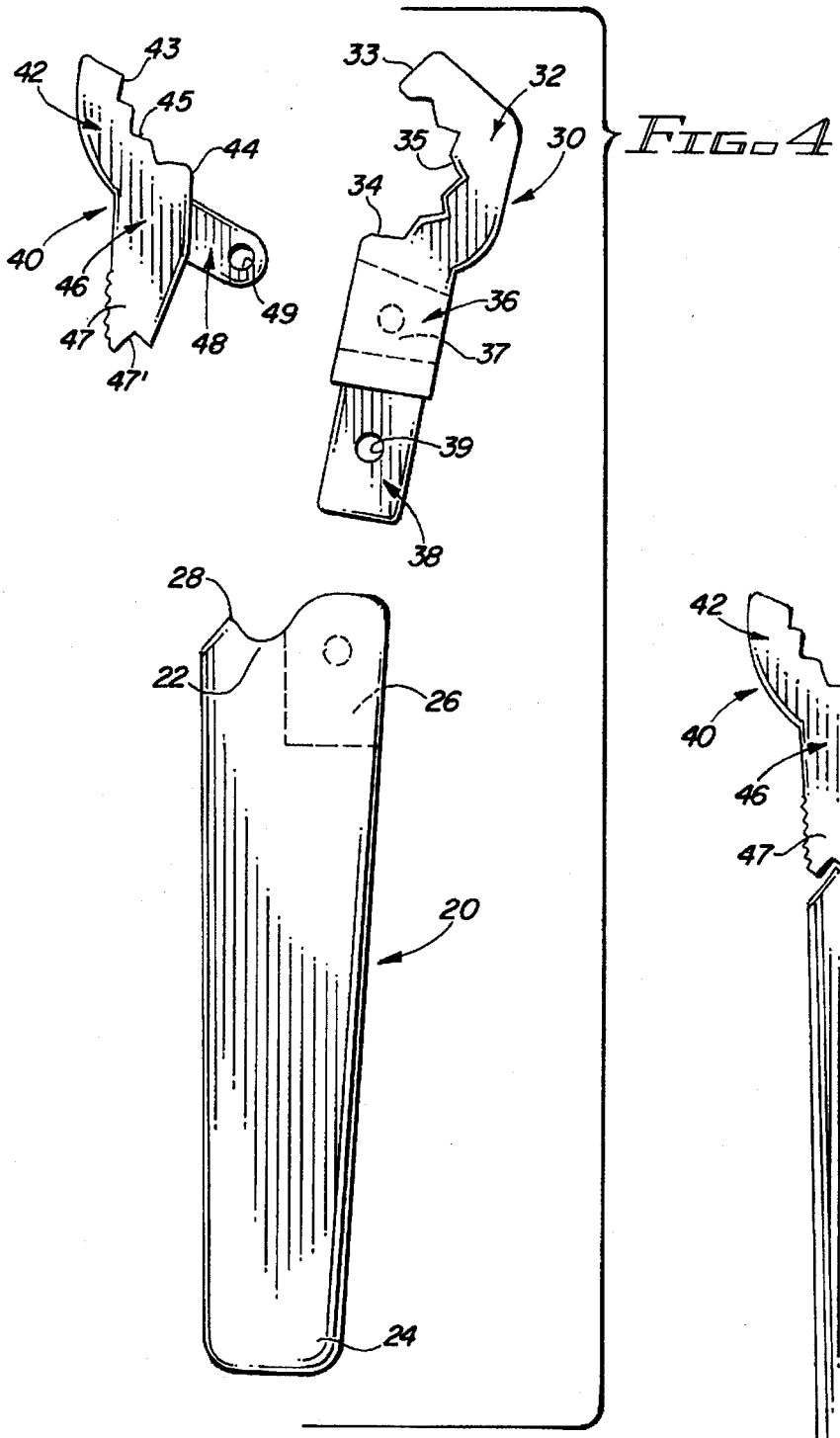
FIG. 4 is an exploded view of the ratcheted wrench assembly of the present invention.

In addition to the first jaw member 30, the side-entry, ratcheted wrench assembly 10 of the present invention further includes a second jaw member 40. The second jaw member 40 is structured to be pivotally secured with the first jaw member 30 and includes a second collar segment 42, a second hub segment 46, and second pivot segment 48. The second collar segment 42, which is preferably smaller than the first collar segment also includes an exterior end 43, an interior end 44 and a second interior contact face 45. Much like the first interior contact face 35, the second interior contact face 45 preferably includes a hex type or notch configuration such that a retention area defined between the first interior contact face 35 and the second interior contact face 45 has a generally hex configuration and is structured to effectively surround the head of a bolt positioned within the retention area. Turning to the second pivot segment 48, it is structured to extend from the second hub segment 46. Further, while the first pivot segment 38 is preferably structured to extend directly down from the first hub segment 36, it is preferred that the second pivot segment 48 extend outwardly from a side of the second hub segment 46 and at a downward angle relative to the second hub segment 46. Specifically, the second pivot segment 48 is structured to be pivotally secured to the first hub segment 36 of the first jaw member 30 so as to provide for pivotal movement of the second jaw member 40 relative to the first jaw member 30 between a generally engaged orientation, as illustrated in FIG. 1, and a generally disengaged orientation as illustrated in FIG. 3. Preferably, the second pivot segment 48 is secured to the first hub segment 36 of the first jaw member 30 within a channel 37 defined within the first hub segment 36, although it is understood that a variety of pivotal interconnection may be effectively employed. Moreover, it is the downward angle of the second pivot segment 48 which substantially facilitates the pivotal movement of the second jaw member 40 and causes the interior end 34 of the first collar segment 32 to abut the interior end 44 of the second collar segment 42 when the jaw members 30 and 40 are in their engaged orientation. It should be noted, that as a result of the abutting engagement of the interior end 34 of the first collar segment 32 and the interior end 44 of the second collar segment 42, the retention area maintains a predefined dimension which does not clamp down on the head of the bolt, but rather merely surrounds it and engages it during rotation of the jaw members 30 and 40 about the bolt. Accordingly, only a torque force exerted by the user through the handle segment 20 results in effective tightening or loosening movement of the bolt as the interior contact faces 35 and 45 engage the facets of the bolt head.

As previously recited, the first and second jaw members 30 and 40 are structured to pivotally move relative to one another between a generally engaged orientation and a generally disengaged orientation. In the generally engaged orientation, the interior end 34 of the first collar segment 32 abuts the interior end 44 of the second collar segment 42 to define the retention area between the first and second interior contact faces 45 and 35. Conversely, the disengaged orientation includes the second jaw member 40 pivoting about a pivot point 49 of the second pivot segment 48 that is secured to the first hub segment 36, such that the exterior ends 33 and 43 of the first and second collar segments 32 and 42 are spaced a maximum distance from one another and side entry of the bolt into the retention area is permitted through the gap defined therebetween.

Also, so as to provide for the effective ratcheting action, and so as to enable the bolt to be tightened or loosened when desired, the ratcheted wrench assembly 10 of the present invention further includes lock means. The lock means are structured to engage the second jaw member 40 and retain it in its engaged orientation when the first jaw member 30 pivots in a first direction relative to the handle segment 20 during tightening or loosening. Turning to the preferred embodiment, the locking means preferably include a lock segment 47 that extends downwardly from the second hub segment 46. The lock segment 47 is downwardly angled away from the first jaw member 30 such that upon pivotal movement of the second jaw member 40 relative to the first jaw member 30, in order to achieve the disengaged orientation, the lock segment 47 will not abut the first hub segment 36 and restrict movement of the jaw members 30 and 40 into the disengaged orientation. The lock segment 47 preferably includes a notch 47' defined in a tip thereof and structured to engage the handle segment 20, and in particular an abutment flange 28 extending from the first end 22 of the handle segment 20. Specifically, the abutment flange 28 preferably includes a wedge-type shape which can effectively and snugly fit into the notch 47' of the lock segment 47 when the first jaw member 30 pivots in its first direction. Accordingly, effective manipulation of the handle segment 20 which results in movement of the first jaw member 30 in the first direction will effectively maintain the first and second collar segments 32 and 42 in the engaged orientation about the head of the bolt and further movement of the handle segment 20 results in a torque force causing a corresponding tightening or loosening of the bolt. In this regard, it is seen that merely by flipping an orientation of the first jaw member 30 and the second jaw member 40 relative to the bolt will alternate the first direction of movement of the first jaw member 30 between a bolt tightening direction and a bolt loosening direction.

Figure 2:
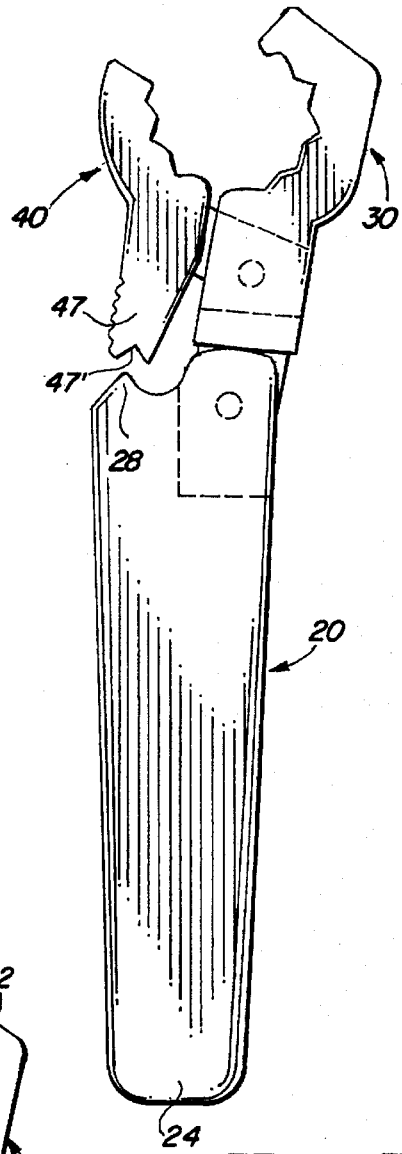
FIG. 2 is a side view of the present invention wherein the first jaw member is moved in said second direction relative to the handle segment.

During effective tightening or loosening of the bolt, and when the handle segment 20 or in fact any portion of the ratcheted wrench assembly 10 turns to a location where further tightening or loosening movement thereof is hindered due to the confined area wherein the bolt is located, moving a handle segment 20 in an opposite direction will result in pivotal movement of the first jaw member in a second direction relative thereto, as illustrated in FIG. 2. It is seen, that upon pivotal movement of the first jaw member 30 into the second direction relative to the handle segment 20, the lock segment 47 will be elevated to a position wherein the notch 47' will not engage the wedge 28 of the handle segment 20, and as such the second jaw member 40 is able to pivot generally into the disengaged orientation. Upon this free pivotal movement of the second jaw member 40 into the disengaged orientation, free ratchet rotation of the first and second collar segments 32 and 42 about the bolt can be achieved without causing rotation of the bolt to substantially counteract the desired tightening or loosening of the bolt.

Figure 5:
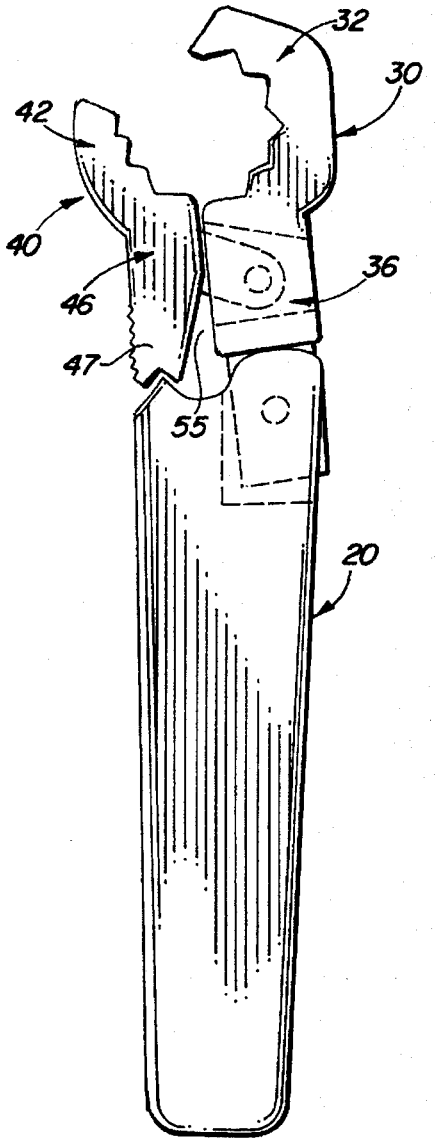
FIG. 5 is a side view of an alternative embodiment of the present invention.

Turning to FIG. 5, it is seen that in another alternative embodiment of the ratcheted wrench assembly 10 of the present assembly biasing means 55 are also included. Specifically, the biasing means 55, preferably in the form of a small spring are structured to normally bias the second jaw member 40 into the engaged orientation wherein the interior end 44 of the second collar segment 42 abuts the interior end 34 of the first collar segment 32. Accordingly, it is seen that the biasing means 55 while normally urging the second jaw member 40 into the engaged orientation, will not urge the jaw members towards one another beyond the abutted engagement of the interior ends and will not cause a clamping down on the bolt which is contained within the retention area. Therefore, a plastic or nonmetal bolt retained within the retention area will not be clamped down upon but will merely be retained within the retention area such that upon rotation of the handle segment 20, and therefore the first and second jaw members 30 and 40 the force exerted thereon to tighten or loosen the bolt is completely a torque force that engages the facets of the bolt and provides minimal risk of damage to the bolt. Additionally, the biasing means 55 are also structured so as to be generally easily overcome to provide for pivoted movement of the second jaw member 40 towards its disengaged orientation upon pivoted movement of the first jaw member 30 into its second direction relative to the handle segment 20 during ratchet type reverse movement of the wrench assembly 10 over the bolt 40. Also in this regard, as previously recited, the first pivot segment 38 preferably abuts an interior of the channel 26 within the handle segment 20 so as to somewhat limit pivotal movement of the first jaw member 30 in that second direction and cause all ratcheting force to be exerted on the second jaw member 40 so as to overcome the biasing means 55 and urge the second jaw member 40 into the disengaged orientation.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A side-entry, ratcheted wrench assembly comprising:

a handle segment, said handle segment including a first end and a second end, a first jaw member, said first jaw member including a first collar segment, a first hub segment, and a first pivot segment extending from said first hub segment, said first collar segment including an exterior end, an interior end, and a first interior contact face extending from said exterior end to said interior end, said first pivot segment being pivotally secured to said handle segment, at generally said first end of said handle segment, a second jaw member, said second jaw member including a second collar segment, a second hub segment, and a second pivot segment extending from said second hub segment, said second collar segment including an exterior end, an interior end, and a second interior contact face extending from said exterior end to said interior end, said second pivot segment being pivotally secured to said first jaw member so as to provide for pivotal movement of said second jaw member relative to said first jaw member between a generally engaged and a generally disengaged orientation, said engaged orientation including said interior end of said first collar segment abutting said interior end of said second collar segment such that said first interior contact face and said second interior contact face define a retention area therebetween wherein a head of a bolt to be turned is retained, said abutting engagement between said interior ends of said first and said second collar segments preventing a clamping force from being exerted on the head of the bolt, said disengaged orientation including said second jaw member pivoting relative to said first jaw member such that said exterior end of said second collar segment and said exterior end of said first collar segment are spaced sufficiently apart from one another to permit side entry of the bolt into said retention area therebetween, lock means structured to engage said second jaw member and retain said second jaw member in said engaged orientation upon said first jaw member, to which said second jaw member is pivotally secured, pivoting in a first direction relative to said handle segment such that further pivotal movement of said first jaw member in said first direction results in corresponding rotation of the bolt within said retention area as a result of a torque force exerted by said first and said second clamp members on the bolt, and said second jaw member being structured to pivot generally into said disengaged orientation upon said first jaw member pivoting in a second direction relative to said handle segment, so as to permit free ratcheted rotation of said first and said second collar segments about the bolt without effecting rotation thereof.

2. A side-entry, ratcheted wrench assembly as recited in claim 1 further including biasing means structured to normally bias said second jaw member into said engaged orientation, said biasing means being structured to be overcome and permit pivoted movement of said second jaw member into said disengaged orientation upon pivoted movement of said first jaw member in said second direction relative to said handle segment.

3. A side-entry, ratcheted wrench assembly as recited in claim 2 wherein said biasing force exerted by said biasing means is insufficient to cause said first and said second interior contact faces to firmly clamp down on and possibly damage the bolt as a result of the abutted engagement between said interior ends of said first and said second collar segments.

4. A side-entry, ratcheted wrench assembly as recited in claim 2 wherein said biasing means includes a spring extending from said first hub segment towards and into engaging relation with said second jaw member.

5. A side-entry, ratcheted wrench assembly as recited in claim 1 wherein said second pivot segment is pivotally secured to said first hub segment.

6. A side-entry, ratcheted wrench assembly as recited in claim 1 wherein said second pivot segment is downwardly angled relative to said second hub segment so as to facilitate pivoted movement of said second jaw member relative to said first jaw member and into said disengaged orientation, while permitting said interior end of said first collar segment to abut said interior end of said second collar segment in said engaged orientation.

7. A side-entry, ratcheted wrench assembly as recited in claim 1 wherein said first hub segment includes a channel defined therein and structured to receive said second pivot segment pivotally secured therein.

8. A side-entry, ratcheted wrench assembly as recited in claim 1 wherein said handle segment includes a channel defined therein and extending into said first end of said handle segment, said channel in said handle segment being structured to receive said first pivot segment pivotally secured therein.

9. A side-entry, ratcheted wrench assembly as recited in claim 1 wherein said lock means includes a lock segment extending from said second hub segment and structured to engage said handle segment so as to maintain said second jaw member in a said engaged orientation while said first jaw member, to which said second jaw member is pivotally secured, pivots in said first direction relative to said handle segment during rotating of said handle segment.

10. A side-entry, ratcheted wrench assembly as recited in claim 9 wherein said lock means further includes an abutment flange extending from said first end of said handle segment and structured to be engage by said lock segment.

11. A side-entry, ratcheted wrench assembly as recited in claim 10 wherein said abutment flange defines a wedge structured to engage a corresponding notch defined in said lock segment.

12. A side-entry, ratcheted wrench assembly as recited in claim 9 wherein said lock segment is angled away from said first jaw member so as to permit pivoted movement of said second jaw member relative to said first jaw member.

13. A side-entry, ratcheted wrench assembly as recited in claim 1 wherein said first and said second interior contact faces define a generally hex type clamping surface.

14. A side-entry, ratcheted wrench assembly as recited in claim 1 wherein flipping an orientation of said first jaw member and said second jaw member relative to the bolt alternates said first and said second directions between a bolt tightening direction and a bolt loosening direction.

* * * * *